US012442138B2

(12) United States Patent
Kurosaki

(10) Patent No.: US 12,442,138 B2
(45) Date of Patent: Oct. 14, 2025

(54) TOILET PAPER ROLL MANUFACTURING METHOD

(71) Applicant: CORELEX SHIN-EI CO., LTD., Fuji (JP)

(72) Inventor: Satoshi Kurosaki, Shizuoka (JP)

(73) Assignee: CORELEX SHIN-EI CO., LTD., Fuji (JP)

( * ) Notice: Subject to any disclaimer, the term of this patent is extended or adjusted under 35 U.S.C. 154(b) by 0 days.

(21) Appl. No.: 18/288,226

(22) PCT Filed: Dec. 19, 2022

(86) PCT No.: PCT/JP2022/046611
§ 371 (c)(1),
(2) Date: Oct. 25, 2023

(87) PCT Pub. No.: WO2023/210056
PCT Pub. Date: Nov. 2, 2023

(65) Prior Publication Data

US 2025/0084591 A1 Mar. 13, 2025

(30) Foreign Application Priority Data

Apr. 28, 2022 (JP) ..... 2022-074149

(51) Int. Cl.
*D21H 27/30* (2006.01)
*D21H 27/00* (2006.01)

(52) U.S. Cl.
CPC ..... *D21H 27/002* (2013.01); *D21H 27/30* (2013.01)

(58) Field of Classification Search
CPC ..... D21H 27/30; D21H 27/002
See application file for complete search history.

(56) References Cited

U.S. PATENT DOCUMENTS

2022/0354315 A1 11/2022 Tanikawa et al.

FOREIGN PATENT DOCUMENTS

| | | | |
|---|---|---|---|
| EP | 1 841 470 | B1 | 2/2010 |
| JP | 2007-260161 | A | 10/2007 |
| JP | 2012-000476 | A | 1/2012 |
| JP | 2018-023561 | A | 2/2018 |
| JP | 2022-031007 | A | 2/2022 |
| KR | 10-2018-0041290 | A | 4/2018 |

(Continued)

OTHER PUBLICATIONS

Extended European Search Report dated Jul. 8, 2024, issued in European Application No. 22937657.9.

(Continued)

*Primary Examiner* — Jeffry H Aftergut
(74) *Attorney, Agent, or Firm* — Sughrue Mion, PLLC

(57) ABSTRACT

A toilet paper roll manufacturing method is provided with which, when 4-ply toilet paper is torn off, individual layered sheets of the paper are prevented from peeling off each other and a good appearance is ensured. The method includes a step of forming laminated paper 101 by bonding base paper 10*a* and base paper 11*a*, a step of forming laminated paper 102 by bonding base paper 13*a* and base paper 12*a*, and a step of spraying a bonding liquid to the laminated paper 101 and the laminated paper 102, stacking and pressing the laminated paper 101 and the laminated paper 102 by pressure rollers 23*c*, and forming 4-ply toilet paper 200.

4 Claims, 3 Drawing Sheets

(56) References Cited

FOREIGN PATENT DOCUMENTS

| | | | | |
|---|---|---|---|---|
| WO | 02/14061 | A1 | | 2/2002 |
| WO | WO-2006/071147 | A1 | * | 7/2006 |
| WO | 2006/099881 | A1 | | 9/2006 |

OTHER PUBLICATIONS

International Search Report for PCT/JP2022/046611 dated Feb. 21, 2023 (PCT/ISA/210).

* cited by examiner

TOILET PAPER ROLL MANUFACTURING METHOD

CROSS REFERENCE TO RELATED APPLICATIONS

This application is a National Stage of International Application No. PCT/JP2022/046611 filed Dec. 19, 2022, claiming priority based on Japanese Patent Application No. 2022-074149 filed Apr. 28, 2022.

TECHNICAL FIELD

The present disclosure relates to a method of manufacturing a 4-ply toilet paper roll that is formed by laminating and rolling up four sheets of paper into a roll.

BACKGROUND ART

Until now, a (1-ply) toilet paper roll formed by rolling up one sheet of paper into a roll or a 2-ply toilet paper roll formed by laminating and rolling up two sheets of base paper into a roll has been manufactured and sold generally.

Furthermore, a toilet paper roll formed by laminating and rolling up three or more sheets of paper into a roll has also been manufactured and sold with intent to increase absorbency.

When the three or more sheets of paper are laminated as described above, the laminated paper is so thick that it is difficult to tear off a pulled-out portion of the laminated paper from a paper roll.

In some of the paper rolls formed by laminating the three or more sheets of paper, perforations are formed in the laminated paper at constant intervals to make the pulled-out portion of the laminated paper easily torn off from the paper roll.

In regard to the manufacturing of the 3-ply toilet paper roll, for example, there is known a method of gluing one ply on a front side to at least one ply in an intermediate layer, forming a micro-embossed pattern in two plies on a rear side, and laminating those three plies in order that the individual plies may become hard to peel off. In regard to the manufacturing of the 4-ply toilet paper roll, there is known a method of forming a decoration embossed pattern in two plies on a front side and forming a micro-embossed pattern in two plies on a rear side. The latter method further includes a step of gluing at least one rear-side ply of the two plies on the front side to at least one front-side ply of the two plies on the rear side (Patent Literature (PTL) 1).

In a variation of the above-mentioned 4-ply toilet paper roll, two layers forming intermediate layers of four plies are glued together. Furthermore, a decoration embossed pattern of large size is formed in two outer-side layers of the four plies, and a micro-embossed pattern formed in the two layers (intermediate layers) glued together are brought into strong contact with the decoration embossed pattern to be laminated in order that those layers may become hard to peel off.

In another example of the above-mentioned 4-ply toilet paper roll, the decoration embossed pattern is formed in one ply on the front side, the micro-embossed pattern is formed in three plies on the rear side, and the one ply on the front side is glued to the second ply from the front side.

CITATION LIST

Patent Literature

PTL 1: Japanese Unexamined Patent Application Publication No. 2018-23561

SUMMARY OF INVENTION

Technical Problem

The 4-ply toilet paper roll manufactured by laminating multiple sheets of paper as described above includes a portion in which those sheets are laminated, for example, while embossed patterns of different sizes are brought into strong contact with each other without using any bonding liquid such as water or glue. Accordingly, there is a possibility that, when a desired length of the toilet paper is torn off in a state in which the toilet paper roll is attached to a toilet paper holder, the individual laminated paper sheets may peel off each other starting from a torn-off end. If the laminated paper sheets stick out of the toilet paper holder in the loosely peeled-off state, an appearance of the toilet paper deteriorates.

The present disclosure has been made in consideration of the above-described problem and provides a toilet paper roll manufacturing method with which, when paper a 4-ply toilet paper roll is torn off, individual layered sheets of the paper are prevented from peeling off each other, and a good appearance is ensured.

Solution to Problem

A toilet paper roll manufacturing method according to the present disclosure includes a first step of pulling out base paper from each of multiple base paper rolls; a second step of introducing multiple sheets of the base paper to a lamination unit, laminating the multiple sheets of the base paper, and forming 4-ply toilet paper; a third step of drying the 4-ply toilet paper; and a fourth step of rolling up the 4-ply toilet paper and manufacturing a 4-ply toilet paper roll, wherein the second step includes a fifth step of separating the multiple sheets of the base paper introduced to the lamination unit into multiple sheets of 1-ply base paper; a sixth step of operating a first sprayer to spray a bonding liquid between first base paper and second base paper among the multiple sheets of 1-ply base paper and forming first laminated paper made up of the first base paper and the second base paper; a seventh step of operating a second sprayer to spray the bonding liquid between third base paper and fourth base paper among the multiple sheets of 1-ply base paper and forming second laminated paper made up of the third base paper and the fourth base paper; and an eighth step of operating a third sprayer to spray the bonding liquid between the first laminated paper and the second laminated paper, and operating a first pressure roller to stack and press the first laminated paper and the second laminated paper and to form the 4-ply toilet paper, the sixth step and the seventh step being performed simultaneously.

The sixth step includes applying the bonding liquid to adhere to the first base paper and the second base paper, and stacking and pressing the first base paper and the second base paper by a second pressure roller, and the seventh step includes applying the bonding liquid to adhere to the third base paper and the fourth base paper, and stacking and pressing the third base paper and the fourth base paper by a third pressure roller.

The eighth step includes operating the second sprayer to spray the bonding liquid in an amount enough for causing fiber-to-fiber gaps in the first laminated paper and fiber-to-fiber gaps in the second laminated paper to widen due to permeation of the bonding liquid; and operating the first pressure roller to apply pressure such that water of the bonding liquid is discharged from the fiber-to-fiber gaps in the first laminated paper and the fiber-to-fiber gaps in the second laminated paper.

Advantageous Effects of Invention

According to the present disclosure, when paper the 4-ply toilet paper roll is torn off, individual layered sheets of the paper are prevented from peeling off each other, and a good appearance is ensured.

DESCRIPTION OF EMBODIMENTS

An embodiment of the present invention will be described below.

Embodiment

Figure 1:
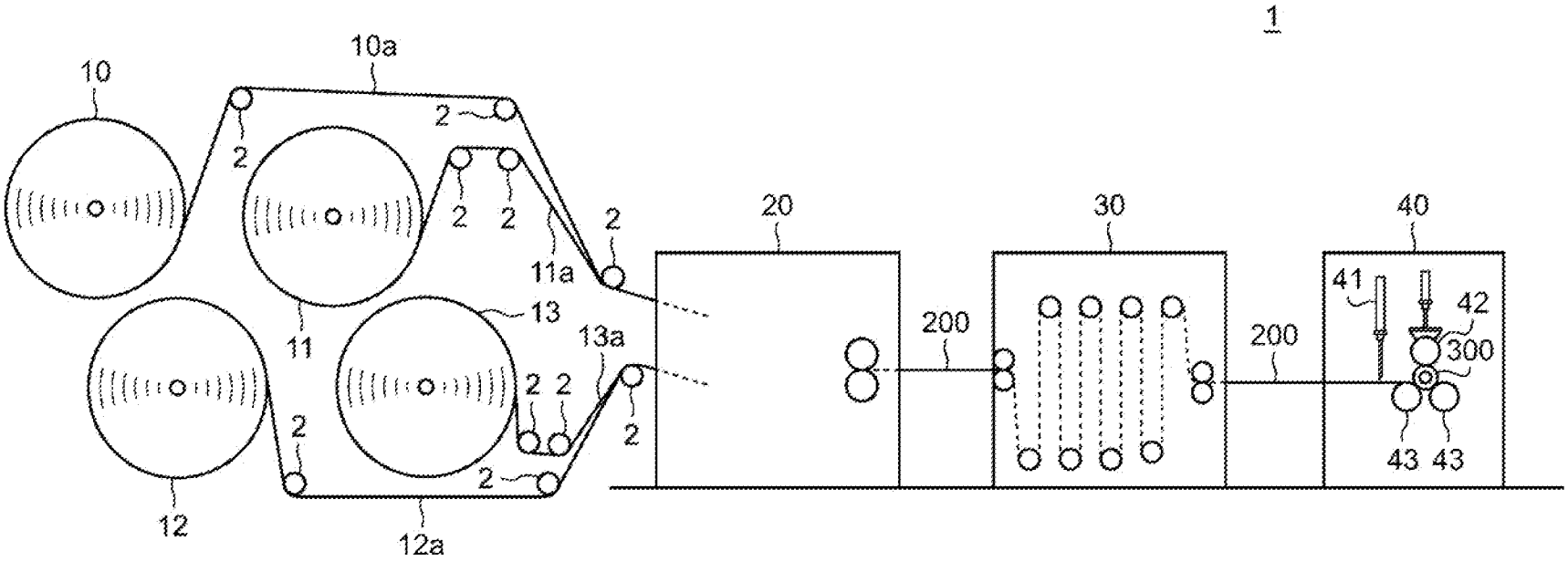
FIG. 1 is an explanatory view illustrating a schematic configuration of a toilet paper roll manufacturing apparatus using a toilet paper roll manufacturing method according to an embodiment of the present disclosure.

FIG. 1 is an explanatory view illustrating a schematic configuration of a toilet paper roll manufacturing apparatus 1 using a toilet paper roll manufacturing method according to the embodiment of the present disclosure.

The toilet paper roll manufacturing apparatus 1 is constituted to manufacture a 4-ply toilet paper roll 300.

The toilet paper roll manufacturing apparatus 1 includes, for example, guide rollers 2 for moving base paper 10*a*, base paper 11*a*, base paper 12*a*, and base paper 13*a* a base paper roll 10, a base paper roll 11, a base paper roll 12, and a base paper roll 13, respectively, to a lamination unit 20, and the lamination unit 20 for stacking the base paper 10*a*, the base paper 11*a*, the base paper 12*a*, and the base paper 13*a* and forming 4-ply toilet paper 200.

The toilet paper roll manufacturing apparatus 1 further includes a drying unit 30 for drying the 4-ply toilet paper 200, and a rolling-up unit 40 for rolling up the 4-ply toilet paper 200 after being dried and forming the 4-ply toilet paper roll 300.

The base paper 10*a*, the base paper 11*a*, the base paper 12*a*, and the base paper 13*a* described here, by way of example, are each 1-ply base paper.

The toilet paper roll manufacturing apparatus 1 illustrated in FIG. 1 is constituted to manufacture the 4-ply toilet paper roll 300 using the base paper 10*a*, the base paper 11*a*, the base paper 12*a*, and the base paper 13*a* each being a 1-ply paper sheet.

In the toilet paper roll manufacturing apparatus 1 of FIG. 1, for example, the multiple guide rollers 2 are installed to guide the base paper 10*a* the base paper roll 10 and the base paper 11*a* the base paper roll 11 to be stacked and introduced to the lamination unit 20, and to guide the base paper 12*a* the base paper roll 12 and the base paper 13*a* the base paper roll 13 to be stacked and introduced to the lamination unit 20.

Figure 2:
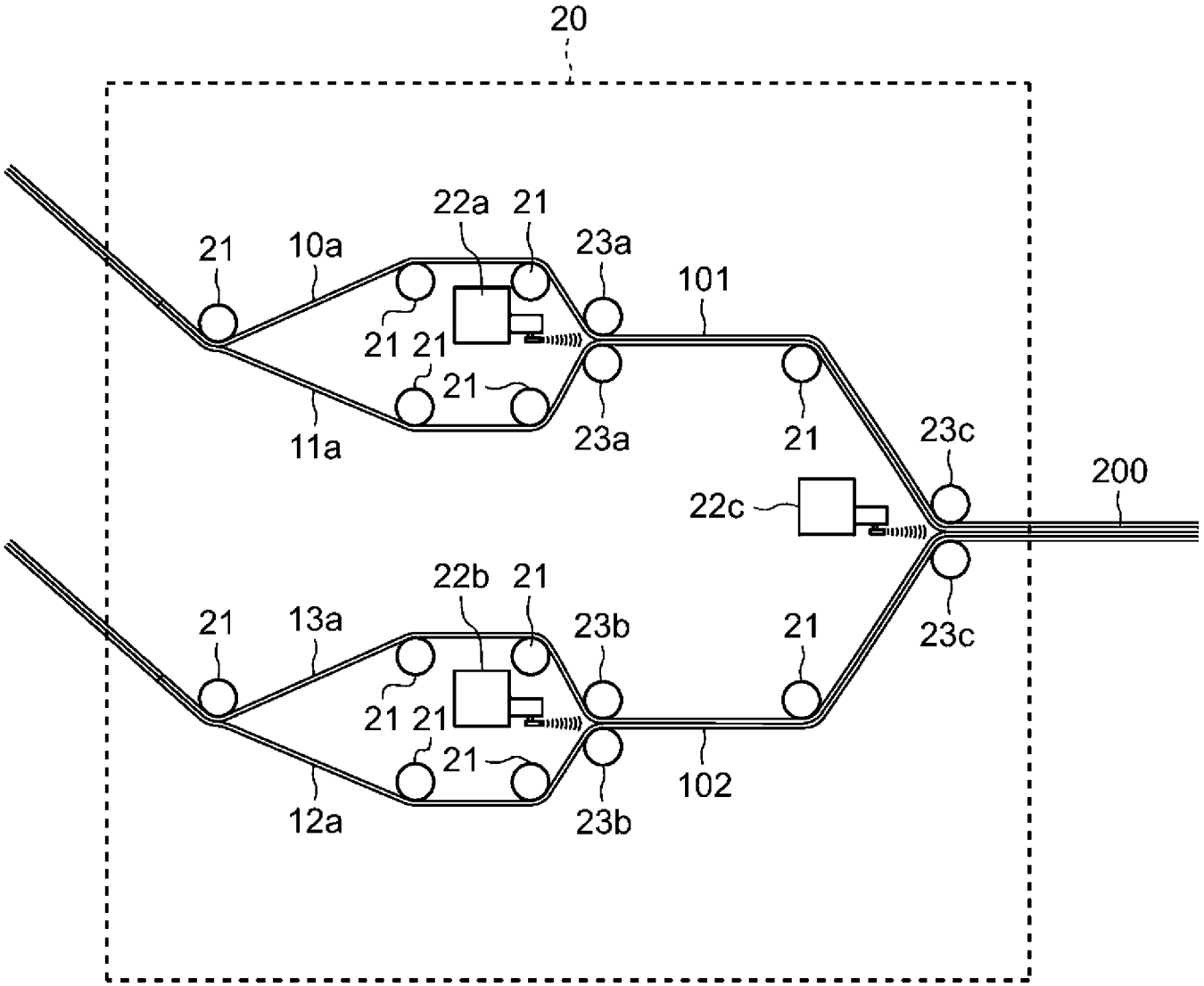
FIG. 2 is an explanatory view illustrating a schematic configuration of a lamination unit included in the toilet paper roll manufacturing apparatus of FIG. 1.

FIG. 2 is an explanatory view illustrating a schematic configuration of the lamination unit 20 included in the toilet paper roll manufacturing apparatus 1 of FIG. 1.

The lamination unit 20 includes a sprayer 22*a* for spraying a bonding liquid, such as an aqueous solution containing water, a perfume ingredient, and a deodorant ingredient, to stacked portions of the base paper 10*a* and the base paper 11*a*, and a sprayer 22*b* for spraying the bonding liquid to stacked portions of the base paper 12*a* and the base paper 13*a*. By spraying water from one of the sprayers 22*a* and 22*b* and spraying an aqueous solution containing the perfume ingredient, for example, from the other one, a concentration of the above-mentioned aqueous solution can be controlled.

The lamination unit 20 includes multiple guide rollers 21 for separating the base paper 10*a* and the base paper 11*a* having been held in a stacked state when they are introduced to the lamination unit 20, and for moving the base paper 10*a* and the base paper 11*a* such that a surface of the base paper 10*a* and a surface of the base paper 11*a*, both the surfaces having been held in contact with each other in the stacked state, are positioned to face the location of a space where the sprayer 22*a* sprays the bonding liquid.

Furthermore, the lamination unit 20 includes other multiple guide rollers 21 for separating the base paper 12*a* and the base paper 13*a* having been held in a stacked state when they are introduced to the lamination unit 20, and for moving the base paper 12*a* and the base paper 13*a* such that a surface of the base paper 12*a* and a surface of the base paper 13*a*, both the surfaces having been held in contact with each other in the stacked state, are positioned to face the location of a space where the sprayer 22*b* sprays the bonding liquid.

The lamination unit 20 includes pressure rollers 23*a* for stacking the base paper 10*a* and the base paper 11*a* and pressing them at the location of the space where the sprayer 22*a* sprays the bonding liquid (or near that location), and pressure rollers 23*b* for stacking the base paper 12*a* and the base paper 13*a* and pressing them at the location of the space where the sprayer 22*b* sprays the bonding liquid (or near that location).

The lamination unit 20 further includes a sprayer 22*c* for, when laminated paper 101 formed by the pressure rollers 23*a* and laminated paper 102 formed by the pressure rollers 23*b* are stacked, spraying the bonding liquid to respective contact surfaces of the laminated paper 101 and the laminated paper 102.

Moreover, the lamination unit 20 includes other multiple guide rollers 21 for moving the laminated paper 101 and the laminated paper 102 to the location of a space where the sprayer 22*c* sprays the bonding liquid, and pressure rollers 23*c* for stacking the laminated paper 101 and the laminated paper 102 and pressing them at the location of the space where the sprayer 22*c* sprays the bonding liquid (or near that location).

An operation of the toilet paper roll manufacturing apparatus 1 will be described below.

In the toilet paper roll manufacturing apparatus 1 of FIG. 1, for example, long sheets of the base paper 10*a*, the base paper 11*a*, the base paper 12*a*, and the base paper 13*a* are the four single-ply base paper rolls 10, 11, 12, and 13, respectively, and are transferred to the lamination unit 20 by the multiple guide rollers 2.

In the lamination unit 20, the sheets of base paper 10*a*, 11*a*, 12*a*, and 13*a* introduced thereto by the guide rollers 2 are laminated after the bonding liquid has been applied to adhere to those sheets as described later, whereby the 4-ply toilet paper 200 of long size is formed.

The 4-ply toilet paper 200 formed in the lamination unit 20 is introduced to the drying unit 30 from the lamination unit 20.

The drying unit 30 includes, for example, multiple cylinders arranged in the inside and dries the 4-ply toilet paper 200 by letting the 4-ply toilet paper 200 having been introduced to the drying unit 30 to pass through the cylinders and by applying heat to the 4-ply toilet paper 200.

The 4-ply toilet paper 200 having been dried in the drying unit 30 is introduced to the rolling-up unit 40.

The rolling-up unit 40 rolls up the 4-ply toilet paper 200, introduced to the rolling-up unit 40, by a rolling-up pressure roller 42 and multiple rolling-up rollers 43. As a result, the 4-ply toilet paper roll 300 is manufactured.

Furthermore, the rolling-up unit 40 includes a cutter 41. After a predetermined length of the 4-ply toilet paper 200 has been rolled up by the rolling-up pressure roller 42 and the rolling-up rollers 43, the 4-ply toilet paper 200 introduced to the rolling-up unit 40 is cut by the cutter 41.

The rolling-up unit 40 repeats a step of successively rolling up the 4-ply toilet paper 200 introduced to the rolling-up unit 40 and a step of cutting the 4-ply toilet paper 200 by the cutter 41 as described above, thus continuing to manufacture the 4-ply toilet paper roll 300.

In some cases, for example, the rolling-up unit 40 may include a cutter (not illustrated) for forming perforations in the 4-ply toilet paper 200 along a width direction, may form the perforations in the 4-ply toilet paper 200 at predetermined intervals, and may manufacture the 4-ply toilet paper roll 300 with the perforations.

FIG. 2 is the explanatory view illustrating the schematic configuration of the lamination unit 20 included in the toilet paper roll manufacturing apparatus 1 of FIG. 1.

In the toilet paper roll manufacturing apparatus 1, for example, the base paper 10*a* and the base paper 11*a* are stacked and introduced to the lamination unit 20 by the guide rollers 2, and the base paper 12*a* and the base paper 13*a* are stacked and introduced to the lamination unit 20 by the other guide rollers 2.

The lamination unit 20 includes the multiple guide rollers 21 and the sprayers 22*a*, 22*b*, and 22*c* for spraying the above-mentioned bonding liquid.

The lamination unit 20 further includes, as described later, the pressure rollers 23*a* for pressing the base paper 10*a* and the base paper 11*a* in the stacked state, the pressure rollers 23*b* for pressing the base paper 12*a* and the base paper 13*a* in the stacked state, and the pressure rollers 23*c* for pressing the laminated paper 101 and the laminated paper 102 in the stacked state.

In the lamination unit 20, when the base paper 10*a* and the base paper 11*a* having been stacked by the guide rollers 2 as described above are introduced thereto, the base paper 10*a* and the base paper 11*a* are separated from each other and are then separately transferred to the vicinity of the sprayer 22*a* by the multiple guide rollers 21.

Those guide rollers 21 transfer the base paper 10*a* and the base paper 11*a*, for example, such that a rear surface of the base paper 10*a* and a front surface of the base paper 11*a* are positioned to face each other at the location of the space where the sprayer 22*a* sprays the bonding liquid. In other words, the guide rollers 21 transfer the base paper 10*a* and the base paper 11*a* in such a way that the rear surface of the base paper 10*a* and the front surface of the base paper 11*a* to face the location toward which the bonding liquid is sprayed from the sprayer 22*a*.

For the base paper 10*a* and the base paper 11*a* having been transferred to the location of the space where the bonding liquid sprayed is able to adhere to each base paper, the sprayer 22*a* sprays the bonding liquid toward, for example, the rear surface of the base paper 10*a* and the front surface of the base paper 11*a* (for adhering to those surfaces).

At that time, the sprayer 22*a* sprays the bonding liquid in an amount enough for, in a state in which fiber-to-fiber gaps on a rear surface side of the base paper 10*a* are widened and fiber-to-fiber gaps on a front surface side of the base paper 11*a* are widened due to permeation of the bonding liquid adhering to the surfaces, enabling the fibers to be intertwined when the base paper 10*a* and the base paper 11*a* are stacked.

The lamination unit 20 includes the pressure rollers 23*a*, for example, at the location of the space where the sprayer 22*a* sprays the bonding liquid (or near that location). The pressure rollers 23*a* bring the rear surface of the base paper 10*a* and the front surface of the base paper 11*a*, those surfaces including the adhering bonding liquid, into a contact (stacked) state, sandwich the base paper 10*a* and the base paper 11*a*, and apply pressure at such a level, for example, that the bonding liquid (water) permeated in the base paper 10*a* and the base paper 11*a* is discharged to the outside.

Stated another way, with the above-described pressing, the bonding liquid (water) acting to widen the fiber-to-fiber gaps on the rear surface side of the base paper 10*a* and the bonding liquid (water) acting to widen the fiber-to-fiber gaps on the front surface side of the base paper 11*a* are discharged from the fiber-to-fiber gaps, and the fibers are intertwined. Hence the 2-ply laminated paper 101 made up of the base paper 10*a* and the base paper 11*a* bonded to each other is formed.

Furthermore, in the lamination unit 20, when the base paper 12*a* and the base paper 13*a* having been stacked by the guide rollers 2 as described above are introduced thereto, the base paper 12*a* and the base paper 13*a* are separated from each other by the multiple guide rollers 21 and are then separately transferred to the vicinity of the sprayer 22*b* by the multiple guide rollers 21.

Those guide rollers 21 transfer the base paper 13*a* and the base paper 12*a*, for example, such that a rear surface of the base paper 13*a* and a front surface of the base paper 12*a* are positioned to face each other at the location of the space where the sprayer 22*b* sprays the bonding liquid. In other words, the guide rollers 21 transfer the base paper 13*a* and the base paper 12*a* in such a way that the rear surface of the base paper 13*a* and the front surface of the base paper 12*a* are positioned to face the location toward which the bonding liquid is sprayed from the sprayer 22*b*.

For the base paper 13*a* and the base paper 12*a* having been transferred to the location of the space where the bonding liquid sprayed is able to adhere to each base paper, the sprayer 22*b* sprays the bonding liquid toward, for example, the rear surface of the base paper 13*a* and the front surface of the base paper 12*a* (for adhering to those surfaces).

At that time, the sprayer 22*b* sprays the bonding liquid in an amount enough for, in a state in which fiber-to-fiber gaps on a rear surface side of the base paper 13*a* are widened and fiber-to-fiber gaps on a front surface side of the base paper 12*a* are widened due to permeation of the bonding liquid adhering to the surfaces, enabling the fibers to be intertwined when the base paper 13*a* and the base paper 12*a* are stacked.

The lamination unit 20 includes the pressure rollers 23*b*, for example, at the location of the space where the sprayer 22*b* sprays the bonding liquid (or near that location). The pressure rollers 23*b* bring the rear surface of the base paper 13*a* and the front surface of the base paper 12*a*, those surfaces including the adhering bonding liquid, into a contact (stacked) state, sandwich the base paper 13*a* and the base paper 12*a*, and apply pressure at such a level, for example, that the bonding liquid (water) permeated in the base paper 13*a* and the base paper 12*a* is discharged to the outside.

Stated another way, with the above-described pressing, the bonding liquid (water) acting to widen the fiber-to-fiber gaps on the rear surface side of the base paper 13*a* and the bonding liquid (water) acting to widen the fiber-to-fiber gaps on the front surface side of the base paper 12*a* are discharged from the fiber-to-fiber gaps, and the fibers are intertwined. Hence the 2-ply laminated paper 102 made up of the base paper 13*a* and the base paper 12*a* bonded to each other is formed.

The lamination unit 20 can simultaneously perform, for example, a step of forming the laminated paper 101 with the aid of the sprayer 22*a*, the pressure rollers 23*a*, and so on, and a step of forming the laminated paper 102 with the aid of the sprayer 22*b*, the pressure rollers 23*b*, and so on.

The laminated paper 101 formed by the pressure rollers 23*a* and the laminated paper 102 formed by the pressure rollers 23*b* are each transferred by the multiple guide rollers 21 to the location of the space where the sprayer 22*c* sprays the bonding liquid. Those guide rollers 21 transfer the laminated paper 101 and the laminated paper 102, for example, such that a rear surface of the laminated paper 101 and a front surface of the laminated paper 102 are positioned to face each other at the location of the space where the sprayer 22*c* sprays the bonding liquid. In other words, the guide rollers 21 transfer the laminated paper 101 and the laminated paper 102 in such a way that the rear surface of the laminated paper 101 and the front surface of the laminated paper 102 are positioned to face the location toward which the bonding liquid is sprayed from the sprayer 22*c*.

For the laminated paper 101 and the laminated paper 102 having been transferred to the location of the space where the bonding liquid sprayed is able to adhere to each laminated paper, the sprayer 22*c* sprays the bonding liquid toward, for example, the rear surface of the laminated paper 101 and the front surface of the laminated paper 102 (for adhering to those surfaces).

At that time, the sprayer 22*c* sprays the bonding liquid in an amount enough for, in a state in which fiber-to-fiber gaps on a rear surface side of the laminated paper 101 are widened and fiber-to-fiber gaps on a front surface side of the laminated paper 102 are widened due to permeation of the bonding liquid adhering to the surfaces, enabling the fibers to be intertwined when the laminated paper 101 and the laminated paper 102 are stacked.

The lamination unit 20 includes the pressure rollers 23*c*, for example, at the location of the space where the sprayer 22*c* sprays the bonding liquid (or near that location). The pressure rollers 23*c* bring the rear surface of the laminated paper 101 and the front surface of the laminated paper 102, those surfaces including the adhering bonding liquid, into a contact (stacked) state, sandwich the laminated paper 101 and the laminated paper 102, and apply pressure at such a level, for example, that the bonding liquid (water) permeated in the laminated paper 101 and the laminated paper 102 is discharged to the outside.

Stated another way, with the above-described pressing, the bonding liquid (water) acting to widen the fiber-to-fiber gaps on the rear surface side of the laminated paper 101 and the bonding liquid (water) acting to widen the fiber-to-fiber gaps on the front surface side of the laminated paper 102 are discharged from the fiber-to-fiber gaps, and the fibers are intertwined. Hence the 4-ply toilet paper 200 made up of the laminated paper 101 and the laminated paper 102 bonded to each other is formed.

The 4-ply toilet paper 200 formed by the pressure rollers 23*c* is dried by the drying unit 30 and rolled up by the rolling-up unit 40 as described above, whereby the 4-ply toilet paper roll 300 is manufactured.

Figure 3:
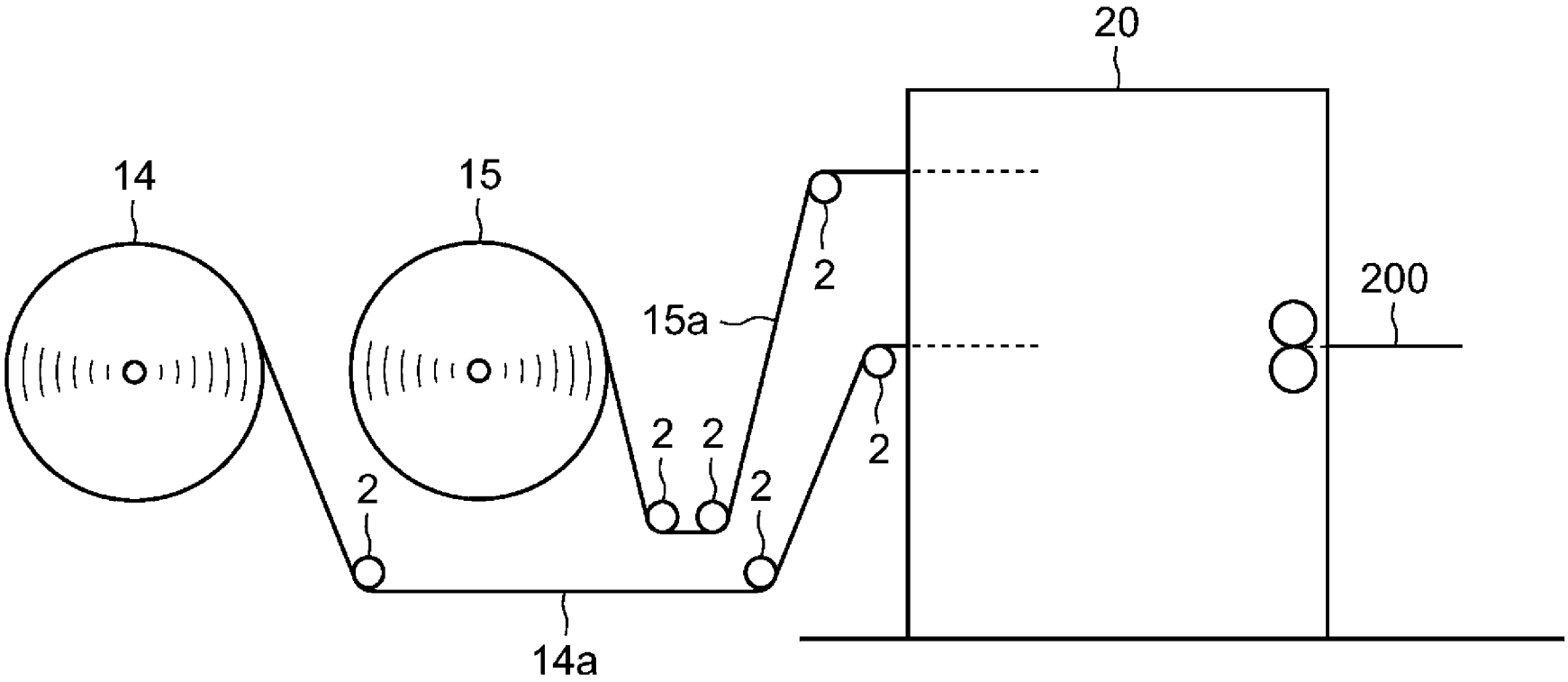
FIG. 3 is an explanatory view illustrating another configuration example of the toilet paper roll manufacturing apparatus of FIG. 1.

FIG. 3 is an explanatory view illustrating another configuration example of the toilet paper roll manufacturing apparatus 1 of FIG. 1. FIG. 3 illustrates part of the other configuration example of the toilet paper roll manufacturing apparatus 1, the part representing a section in which sheets of base paper 14*a* and 15*a* base paper rolls 14 and 15, respectively, are introduced to a lamination unit 20.

In the other configuration example of the toilet paper roll manufacturing apparatus 1, the lamination unit 20, a drying unit 30, a rolling-up unit 40, and so on are similar to those illustrated in FIGS. 1 and 2.

The base paper roll 14 and the base paper roll 15 are formed, for example, by rolling up respectively the base paper 14*a* and the base paper 15*a* each of which is made up of 2-ply paper sheets that are not bonded to each other with the bonding liquid or the like.

In the other configuration example illustrated in FIG. 3, the 2-ply base paper 14*a* the base paper roll 14 and the 2-ply base paper 15*a* the base paper roll 15 are each guided by multiple guide rollers 2 and introduced to the lamination unit 20.

The lamination unit 20 illustrated in FIG. 3 has a similar configuration to that of the lamination unit 20 illustrated in FIG. 2. In the lamination unit 20, for example, the base paper 14*a* is separated into first 1-ply base paper (not illustrated) corresponding to the base paper 10*a* and second 1-ply base paper (not illustrated) corresponding to the base paper 11*a*, and similar treatment to that for the base paper 10*a* and the base paper 11*a* is performed on the first 1-ply base paper and the second 1-ply base paper.

Furthermore, in the lamination unit 20 in FIG. 3, the base paper 15*a* is separated into third 1-ply base paper (not illustrated) corresponding to the base paper 13*a* and fourth 1-ply base paper (not illustrated) corresponding to the base paper 12*a*, and similar treatment to that for the base paper 13*a* and the base paper 12*a* is performed on the third 1-ply base paper and the fourth 1-ply base paper.

In the lamination unit 20 in FIG. 3, too, the laminated paper 101 and the laminated paper 102 are formed, and the 4-ply toilet paper 200 is formed as in the above-described embodiment.

The toilet paper roll manufacturing apparatus 1 described here can be constituted to supply, to the lamination unit 20, not only the sheets of 1-ply base paper 10*a*, 11*a*, 12*a*, and 13*a* from the base paper rolls 10, 11, 12, and 13, respectively, but also the sheets of 2-ply base paper 14*a* and 15*a* from the base paper rolls 14 and 15, respectively.

REFERENCE SIGNS LIST

1 toilet paper roll manufacturing apparatus
2 guide roller

10 base paper roll
10*a* base paper
11 base paper roll
11*a* base paper
12 base paper roll
12*a* base paper
13 base paper roll
13*a* base paper
14 base paper roll
14*a* base paper
15 base paper roll
15*a* base paper
20 lamination unit
21 guide roller
22*a*, 22*b*, 22*c* sprayer
23*a*, 23*b*, 23*c* pressure roller
30 drying unit
40 rolling-up unit
41 cutter
42 rolling-up pressure roller
43 rolling-up roller
101, 102 laminated paper
200 4-ply toilet paper
300 4-ply toilet paper roll

The invention claimed is:

1. A toilet paper roll manufacturing method comprising:

a first step of pulling out base paper from each of multiple base paper rolls;

a second step of introducing multiple sheets of the base paper to a lamination unit, laminating the multiple sheets of the base paper, and forming 4-ply toilet paper;

a third step of drying the 4-ply toilet paper; and a fourth step of rolling up the 4-ply toilet paper and manufacturing a 4-ply toilet paper roll, wherein the second step comprises:

a fifth step of separating the multiple sheets of the base paper introduced to the lamination unit into multiple sheets of 1-ply base paper;

a sixth step of operating a first sprayer to spray a bonding liquid between first base paper and second base paper among the multiple sheets of 1-ply base paper and forming first laminated paper made up of the first base paper and the second base paper;

a seventh step of operating a second sprayer to spray the bonding liquid between third base paper and fourth base paper among the multiple sheets of 1-ply base paper and forming second laminated paper made up of the third base paper and the fourth base paper; and an eighth step of operating a third sprayer to spray the bonding liquid between the first laminated paper and the second laminated paper, and operating a first pressure roller to stack and press the first laminated paper and the second laminated paper and to form the 4-ply toilet paper, the sixth step and the seventh step being performed simultaneously.

2. The toilet paper roll manufacturing method according to claim 1, wherein the sixth step comprises applying the bonding liquid to adhere to the first base paper and the second base paper, and stacking and pressing the first base paper and the second base paper by a second pressure roller, and the seventh step comprises applying the bonding liquid to adhere to the third base paper and the fourth base paper, and stacking and pressing the third base paper and the fourth base paper by a third pressure roller.

3. The toilet paper roll manufacturing method according to claim 1, wherein the eighth step comprises:

operating the second sprayer to spray the bonding liquid in an amount enough for causing fiber-to-fiber gaps in the first laminated paper and fiber-to-fiber gaps in the second laminated paper to widen due to permeation of the bonding liquid; and operating the first pressure roller to apply pressure such that water of the bonding liquid is discharged from the fiber-to-fiber gaps in the first laminated paper and the fiber-to-fiber gaps in the second laminated paper.

4. The toilet paper roll manufacturing method according to claim 2, wherein the eighth step comprises:

operating the second sprayer to spray the bonding liquid in an amount enough for causing fiber-to-fiber gaps in the first laminated paper and fiber-to-fiber gaps in the second laminated paper to widen due to permeation of the bonding liquid; and operating the first pressure roller to apply pressure such that water of the bonding liquid is discharged from the fiber-to-fiber gaps in the first laminated paper and the fiber-to-fiber gaps in the second laminated paper.

* * * * *